US006017667A

United States Patent [19]

Hakata

[11] Patent Number: 6,017,667

[45] Date of Patent: Jan. 25, 2000

[54] SPHERICAL-LIKE COMPOSITE PARTICLES AND ELECTROPHOTOGRAPHIC MAGNETIC CARRIER

[75] Inventor: Toshiyuki Hakata, Hiroshima, Japan

[73] Assignee: Toda Kogyo Corporation, Japan

[21] Appl. No.: 09/047,530

[22] Filed: Mar. 25, 1998

[30] Foreign Application Priority Data

Mar. 27, 1997 [JP] Japan ..... 9-094721

[51] Int. Cl.[7] ..... G03G 9/083

[52] U.S. Cl. ..... 430/106.6; 430/108; 252/62.54

[58] Field of Search ..... 430/106.6, 108, 430/111; 252/62.54

[56] References Cited

U.S. PATENT DOCUMENTS

| | | | |
|---|---|---|---|
| 4,336,546 | 6/1982 | Edwards et al. . | |
| 4,546,060 | 10/1985 | Miskinis et al. | 430/106.6 |
| 4,623,603 | 11/1986 | Iimura et al. | 430/106.6 |

FOREIGN PATENT DOCUMENTS

| | | |
|---|---|---|
| 0 384 697 | 8/1990 | European Pat. Off. . |
| 0 410 788 A1 | 1/1991 | European Pat. Off. . |
| 0 559 250 A1 | 9/1993 | European Pat. Off. . |
| 0 580 135 A1 | 1/1994 | European Pat. Off. . |
| 0 708 379 A2 | 4/1996 | European Pat. Off. . |
| 60 196777 | 3/1984 | Japan . |

OTHER PUBLICATIONS

Diamond, Arthur S. (editor) Handbook of Imaging Materials. New York: Marcel–Dekker, Inc. pp. 201–225, 1991.

*Primary Examiner*—Christopher D. Rodee
*Attorney, Agent, or Firm*—Nixon & Vanderhye

[57] ABSTRACT

Spherical-like composite particles having an average particle size of 1 to 1,000 $\mu$m, a volume resistivity of $10^{10}$ to $10^{13}$ Ωcm and a coercive force of 100 to 4,000 Oe, comprising:

magnetically hard particles, magnetically soft particles and a phenol resin as a binder, the total amount of said magnetically hard particles and said magnetically soft particles being 80 to 99% by weight based on the total weight of said spherical-like composite particles, and the ratio ($\phi_a/\phi_b$) of an average particle size ($\phi_a$) of said magnetically hard particles to an average particle size ($\phi_b$) of said magnetically soft particles being more than 1.

21 Claims, 1 Drawing Sheet

(×1000)

(×1000)

(×3000)

SPHERICAL-LIKE COMPOSITE PARTICLES AND ELECTROPHOTOGRAPHIC MAGNETIC CARRIER

BACKGROUND OF THE INVENTION

The present invention relates to spherical-like composite particles and an electrophotographic magnetic carrier comprising the spherical-like composite particles, and more particularly, to spherical-like composite particles having a freely controllable coercive force and a high volume resistivity, and an electrophotographic magnetic carrier comprising the spherical-like composite particles.

The spherical-like composite particles according to the present invention can be mainly applied to a developing material for developing an electrostatic latent image, such as an electrophotographic magnetic carrier and an electrophotographic magnetic toner, a wave absorbing material, an electromagnetic shielding material, an ion exchange resin material, a display material, a damping material or the like. Especially, the spherical-like composite particles according to the present invention can be suitably used as the electrophotographic magnetic carrier.

In recent years, as materials having a high performance and novel functions, there have been proposed various composite particles made of different kinds of materials. As one of these composite particles, those composed of inorganic particles and an organic high-molecular weight compound have been variously studied and developed, and put into practice.

In the case where magnetic particles are used as the inorganic particles, the composite particles containing the magnetic particles have been used in various applications such as a developing material for developing a electrostatic latent image, such as an electrophotographic magnetic carrier and an electrophotographic magnetic toner, a wave absorbing material, an electromagnetic shielding material, an ion exchange resin material, a display material or a damping material or the like.

In any of the above-mentioned application fields, the composite particles have been demanded to satisfy such requirements (1) that the content of magnetic particles is as large as possible such that various properties and functions of the magnetic particles can be exhibited to a sufficient extent; (2) that the composite particles are of a spherical shape in order to improve particle properties such as fluidity or packing property; and (3) that the particle size of the composite particles can be controlled in a wide range, especially 1 to 1,000 $\mu$m, so as to enable the selection of a desired particle size according to intended applications.

First, there is described the application of the composite particles to a developer for developing an electrostatic latent image. As is known in conventional electrophotographic methods, a photosensitive material made of a photoconductive substance such as selenium, OPC (organic semiconductor) or $\alpha$-silicon has been used to form an electrostatic latent image thereon by various means. The thus formed electrostatic latent image is developed using magnetic brush development method or the like by electrostatically attaching thereto a toner having a polarity opposite to that of the latent image, thereby producing a visible toner image.

In the development system, so-called carrier particles are used to impart an appropriate amount of positive or negative charge to a toner by frictional electrification therebetween. In addition, the toner is delivered through a developing sleeve into a developing zone near a surface of the photosensitive material where the latent image is formed, by exerting a magnetic force of a magnet accommodated within the developing sleeve.

In recent years, the electrophotographic methods have been extensively used in copying machines, printers or the like. In these application fields, it has been required that thin lines, small characters, photographs or color original documents are exactly copied or printed. In addition, it has also been required to obtain high-image quality and high-grade quality, and achieve high-speed and continuous image formation. These demands are considered to increase more and more in future.

In general, the development of the electrostatic latent image has been conducted by a magnetic brush development method using a magnetic carrier having a constant coercive force. In this case, it is known that the obtained image quality is varied depending upon a magnitude of coercive force used.

Specifically, in the case where the coercive force is small, high image density can be obtained while definition or gradation of images are deteriorated. On the other hand, in the case where the coercive force is large, the definition or gradation of images are improved while the image density is deteriorated. This is because the small coercive force leads to formation of a magnetic brush with a large height and to a low toner density, while the large coercive force causes formation of a magnetic brush with a small height and a large toner density.

Further, there is a close relationship between coercive force and print speed.

Recently, the print speed of copying machines or printers has been considerably increased as compared to conventional ones. In order to increase the print speed, it is necessary to increase a developing speed of these apparatuses. In order to achieve a high developing speed, it is necessary that the magnetic carrier can be firmly held on the surface of the developing sleeve rotating at a high speed. Therefore, it is preferred that the coercive force of magnetic carrier be large to some extent, because a magnetic brush having a small height and a high toner density can be assured by using such a magnetic carrier having a large coercive force.

In order to satisfy both high image quality and high- speed printing, it is required that the coercive force of magnetic carrier is freely controllable according to the system used.

Further, there has been a recent tendency that the particle size of toner is reduced in order to obtain a high image quality. With the decrease in particle size of the toner, the particle size of magnetic carrier has also been reduced.

However, when the particles sizes of toner and carrier are reduced, there arises a problem that the fluidity of a developer composed of these small particles is deteriorated. Therefore, there has been a demand for a toner and a carrier having a good fluidity.

Hitherto, various attempts have been performed to control a coercive force of the magnetic carrier. For example, there has been proposed an electrophotographic magnetic carrier comprising magnetic particles having a high coercive force and magnetic particles having a low coercive force in combination (Japanese Patent Applications Laid-open Nos. 60-144759(1985) and 60-196777(1985)).

However, the above-mentioned conventional magnetic carrier is in the form of a mixture comprising different kinds of carrier particles having different coercive forces and, therefore, separated into individual groups of carrier particles in a developing device, so that there arise a problem that defects of the carrier particles are exhibited as they are.

Further, in order to solve the above-mentioned problems, in Japanese Patent Application Laid-open No. 2-88429 (1990), there has been proposed so-called composite particles made of ferrite particles which contain both magnetic particles having a small coercive force and magnetic particles having a large coercive force.

However, in the case of such composite particles, although the above-mentioned problem concerning the separation of particles into individual groups is solved, there arises another problem that since these particles composed of ferrite solely, have a large specific gravity and exert a large stress onto a toner, the durability of a developer is deteriorated after a long-term use thereof. Further, since the composite particles are of non-spherical shape, the fluidity thereof is unsatisfactory.

Further, in Japanese Patent Application Laid-open No. 6-11906(1994), there has been described a binder-type carrier, i.e., a magnetic carrier containing magnetic particles having a coercive force of not less than 300 Oe and magnetic particles of less than 300 Oe.

More specifically, in Japanese Patent Application Laid-open No. 6-11906(1994), there has been described a magnetic carrier used for a magnetic brush toner/carrier development of an electrostatic charge pattern, comprising a binder resin and fine magnetic pigment particles dispersed in the binder resin, wherein said magnetic pigment particles are in the form of a mixture of a part (A) having a coercive force of not less than 300 Oe and another part (B) having a coercive force of less than 300 Oe, with the weight ratio of the part (A) to the part (B) being in the range of 0.1 to 10.

However, since these particles are of a non-spherical shape due to the production method, the fluidity thereof is deteriorated.

Besides, in Japanese Patent Application Laid-open No. 6-35231(1994), there has been proposed a magnetic substance dispersing-type resin carrier having a composite phase of a spinel structure and a magnetoplumbite structure.

More specifically, in Japanese Patent Application Laid-open No. 6-35231(1994), there has been described a magnetic substance dispersing-type resin carrier comprising a binder resin, and magnetic particles dispersed in the binder resin and having a particle size of 5 to 100 $\mu$m, a bulk density of not more than 3.0 g/cm$^3$, and magnetic properties that the magnetization ($\sigma_{1000}$) at a magnetic field of 1,000 Oe is 30 to 150 emu/cm$^3$; the magnetization at a magnetic field of 0 Oe (residual magnetization: $\sigma_r$) is not less than 25 emu/cm$^3$; and the coercive force is less than 300 Oe, the content of the magnetic particles being 30 to 99% by weight based on the total weight of the carrier.

However, in these particles, the content of particles having a magnetoplumbite structure is smaller than that of particles having a spinel structure, so that the composite particles has a low coercive force. In addition, the volume resistivity of the composite particles is considerably influenced by the weight ratio between two types of particles. Therefore, it is difficult to adjust the volume resistivity to a level as high as required.

As a result of the present inventors' earnest studies, it has been found that by dispersing magnetically hard particles having a coercive force of not less than 500 Oe and magnetically soft particles having a coercive force of less than 500 Oe in a specific amount of a phenol resin binder, in which the ratio of an average particle size of the magnetically hard particles to that of the magnetically soft particles lies in a specific range, the obtained spherical-like composite particles can exhibit a desired coercive force and a desired high volume resistivity, and are suitable as an electrophotographic magnetic carrier. The present invention has been attained on the basis of this finding.

SUMMARY OF THE INVENTION

It is an object of the present invention to provide spherical-like composite particles having magnetic properties as required, especially a freely controllable coercive force and a high volume resistivity, and suitable especially as an electrophotographic magnetic carrier.

It is another object of the present invention to provide an electrophotographic carrier having a coercive force suited for an electrophotographic system used and a good fluidity.

To accomplish the aim, in a first aspect of the present invention, there is provided spherical-like composite particles having an average particle size of 1 to 1,000 $\mu$m, a volume resistivity of $10^{10}$ to $10^{13}$ Ωcm and a coercive force of 100 to 4,000 Oe, comprising:

magnetically hard particles, magnetically soft particles and a phenol resin as a binder, the total amount of said magnetically hard particles and said magnetically soft particles being 80 to 99% by weight based on the total weight of said spherical-like composite particles, and the ratio ($\phi_a/\phi_b$) of an average particle size ($\phi_a$) of said magnetically hard particles to an average particle size ($\phi_b$) of said magnetically soft particles being more than 1.

In a second aspect of the present invention, there is provided spherical-like composite particles having an average particle size of 1 to 1,000 $\mu$m, a volume resistivity of $10^{10}$ to $10^{13}$ Ωcm and a coercive force of 100 to 4,000 Oe, comprising:

magnetically hard particles having a lipophilic agent coat on at least a part of the surface thereof; magnetically soft particles having a lipophilic agent coat on at least a part of the surface thereof; and a phenol resin as a binder, the total amount of the magnetically hard particles and the magnetically soft particles being 80 to 99% by weight based on the total weight of the spherical-like composite particles, and the ratio of an average particle size ($\phi_a$) of the magnetically hard particles to an average particle size ($\phi_b$) of the magnetically soft particles being more than 1.

In a third aspect of the present invention, there is provided an electrophotographic magnetic carrier comprising spherical-like composite particles defined in the first aspect or second aspect.

DETAILED DESCRIPTION OF THE INVENTION

Figure 1:
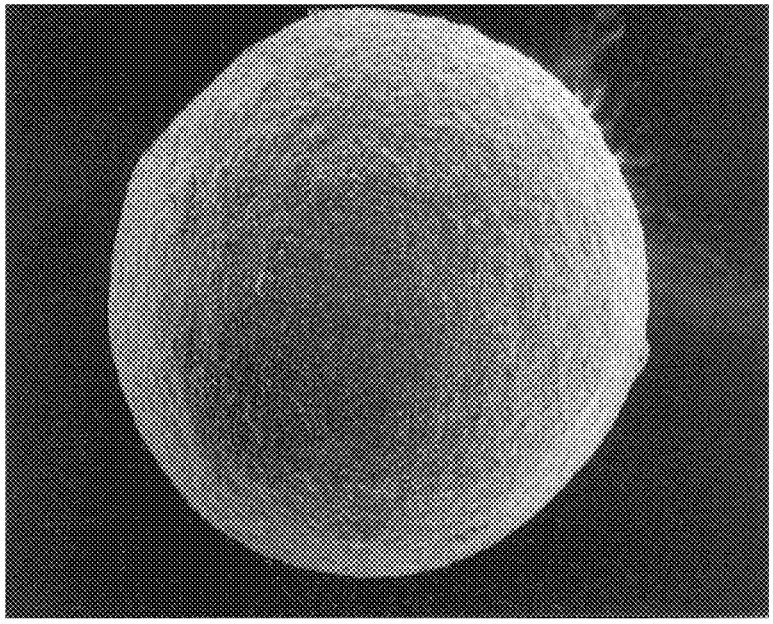
FIG. 1 is a scanning electron microscope photograph (×1,000) showing a particle structure of spherical-like composite particles obtained in Example 1 of the present invention.
Figure 2:
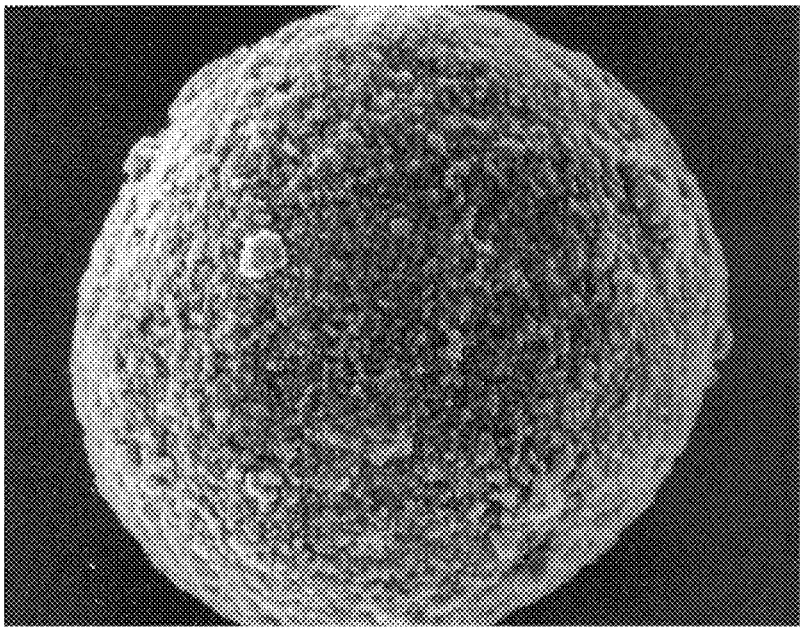
FIG. 2 is a scanning electron microscope photograph (×3,000) showing a particle structure of spherical-like composite particles obtained in Example 2 according to the present invention.

First, the spherical-like composite particles according to the present invention are described.

The spherical-like composite particles according to the present invention has an average particle size of 1 to 1,000

μm. When the average particle size is less than 1 μm, the composite particles tend to cause a secondary agglomeration. On the other hand, when the average particle size is more than 1,000 μm, the composite particles have a low mechanical strength and cannot produce a clear image when used as an electrophotographic carrier. Especially, in the case where it is intended to produce a high quality image, the average particle size of the composite particles according to the present invention is preferably 20 to 200 μm, more preferably 30 to 100 μm.

The spherical-like composite particles according to the present invention has such a structure that the magnetically hard particles having a coercive force of usually not less than 500 Oe and the magnetically soft particles having a coercive force of usually less than 500 Oe are integrated through the cured phenol resin as a binder.

The ratio ($\phi_a/\phi_b$) of an average particle size ($\phi_a$) of the magnetically hard particles to an average particle size ($\phi_b$) of the magnetically soft particles is usually more than 1, preferably not less than 1.2, more preferably 1.2 to 100. When the ratio ($\phi_a/\phi_b$) is not more than 1, the magnetically soft particles tend to be exposed to the surfaces of spherical-like composite particles, so that the volume resistivity thereof as a whole becomes low.

In the spherical-like composite particles according to the present invention, the total content of the magnetically hard particles and the magnetically soft particles is 80 to 99% by weight based on the total weight of the spherical-like composite particles. When the total content of the magnetically hard and soft particles is less than 80% by weight, it is difficult to produce the composite particles having a desired specific gravity, and as a result, it may become insufficient to mix such composite particles with a toner. On the other hand, when the total content of the magnetically hard and soft particles is more than 99% by weight, the content of resin component therein is unsatisfactory, so that the composite particles cannot exhibit a sufficient mechanical strength.

The mixing ratio (weight ratio) of the magnetically hard particles to the magnetically soft particles is preferably 1:99 to 99:1, more preferably 10:90 to 90:10.

The spherical-like composite particles according to the present invention, have a bulk density of preferably not more than 2.5 g/cm$^3$, more preferably not more than 2.0 g/cm$^3$. The specific gravity of the spherical-like composite particles according to the present invention, is usually 2.2 to 5.2, preferably 2.5 to 4.5.

The coercive force of the spherical-like composite particles according to the present invention, is 100 to 4,000 Oe, preferably 150 to 3,000 Oe.

The volume resistivity of the spherical-like composite particles according to the present invention, is $10^{10}$ to $10^{13}$ Ωcm, preferably $10^{11}$ to $10^{13}$ Ωcm.

The fluidity of the spherical-like composite particles according to the present invention, is usually not more than 100 seconds, preferably not more than 80 seconds.

The composite particles according to the present invention, are of such a spherical shape that the sphericity thereof is usually 1.0 to 1.5, preferably 1.0 to 1.4.

The saturation magnetization of the spherical-like composite particles according to the present invention, is usually not less than 30 emu/g, preferably not less than 40 emu/g.

Next, the process for producing the spherical-like composite particles according to the present invention, is described below.

The spherical-like composite particles according to the present invention, can be produced by reacting phenols with aldehydes in an aqueous solvent in the presence of a basic catalyst under coexistence of magnetically hard particles having a coercive force of not less than 500 Oe and magnetically soft particles having a coercive force of less than 500 Oe.

Examples of the phenols may include phenol; alkyl phenols such as m-cresol, p-tert-butyl phenol, o-propyl phenol, resorcinol or bisphenol A; compounds having a phenolic hydroxyl group, e.g., halogenated phenols having chlorine or bromine groups substituted for a part or a whole of hydrogens bonded to a benzene ring or contained in an alkyl group of the phenols; or the like. In the case where compounds other than phenol are used as the phenols, it is sometimes difficult to form composite particles, or even though composite particles are formed, the obtained particles are occasionally of an irregular shape. In view of the shape of obtained particles, phenol is more preferable.

Examples of the aldehydes may include formaldehyde in the form of formalin or paraformaldehyde, furfural or the like. Among these aldehydes, formaldehyde is preferred.

The molar ratio of the aldehydes to the phenols is preferably 1:1 to 4:1, more preferably 1.2:1 to 3:1. When the molar ratio of the aldehydes to the phenols is less than 1:1, it becomes difficult to form composite particles, or even if composite particles are formed, the resin is difficult to cure so that obtained composite particles tend to have a low mechanical strength. On the other hand, when the molar ratio of the aldehydes to the phenols is more than 4:1, there is a tendency that the amount of unreacted aldehydes remaining in the aqueous solvent is increased.

As the basic catalyst, there may be exemplified basic catalysts used for ordinary production of resorcinol resins. Examples of these basic catalysts may include ammonia water, hexamethylene tetramine, alkyl amines such as dimethyl amine, diethyl triamine or polyethylene imine, or the like.

The molar ratio of the basic catalyst to the phenols is preferably 0.02:1 to 0.3:1. When the molar ratio of the basic catalyst to the phenols is less than 0.02:1, the resin may not is sufficiently cured, resulting in unsatisfactory granulation of particles. On the other hand, when the molar ratio of the basic catalyst to the phenols is more than 0.3:1, the structure of the phenol resin may be adversely affected, also resulting in deteriorated granulation of particles, so that it is difficult to obtain particles having a large particle size.

As the magnetically hard particles having a coercive force of not less than 500 Oe used in the present invention, there may be used magnetoplumbite-type magnetic particles represented by the formula: $MFe_{12}O_{19}$, wherein M is at least one element selected from the group consisting of strontium, barium, calcium and lead; magnetic iron particles having an oxide layer on the surface thereof; magnetic iron-based alloy particles having an oxide layer on the surface thereof; or the like.

Among these particles, the magnetoplumbite-type magnetic particles are preferred.

The magnetically hard particles may be of any suitable shape such as a plate-like shape, a granular shape, a spherical-like shape or an acicular shape.

The average particle size ($\phi_a$) of the magnetically hard particles is usually 0.05 to 10 μm, preferably 0.1 to 5 μm.

The coercive force of the magnetically hard particles is not less than 500 Oe, preferably 700 to 5,000 Oe, more preferably 1,000 to 4,000 Oe.

The volume resistivity $R_h$ of the magnetically hard particles is usually $10^9$ to $10^{13}$ Ωcm, preferably $10^{10}$ to $10^{13}$ Ωcm.

As the magnetically soft particles having a coercive force of less than 500 Oe according to the present invention, there may be used magnetite particles, maghemite particles, spinel-type ferrite particles containing at least one metal other than iron, selected from the group consisting of Mn, Ni, Zn, Mg, Cu, etc., or the like. Among these particles, the spinel-type ferrite particles are preferred.

The magnetically soft particles may be of any suitable shape such as a spherical shape, a granular shape, an acicular shape or a plate-like shape.

The average particle size ($\phi_b$) of the magnetically soft particles is usually 0.02 to 5 μm, preferably 0.05 to 3 μm.

In accordance with the present invention, the ratio ($\phi_a/\phi_b$) of the average particle size ($\phi_a$) of the magnetically hard particles to the average particle size ($\phi_b$) of the magnetically soft particles is more than 1. The ratio ($\phi_a/\phi_b$) is preferably not less than 1.2, more preferably 1.2 to 100. When the ratio ($\phi_a/\phi_b$) is not more than 1, the magnetically soft particles having a relatively low volume resistivity tend to be exposed to the surfaces of the spherical-like composite particles, so that the volume resistivity of the spherical-like composite particles becomes reduced.

The coercive force of the magnetically soft particles according to the present invention is less than 500 Oe, preferably 1 to 400 Oe, more preferably 1 to 300 Oe.

The volume resistivity $R_s$ of the magnetically soft particles according to the present invention is usually $10^5$ to $10^{11}$ Ωcm, preferably $10^7$ to $10^{11}$ Ωcm.

The relationship between the volume resistivity $R_h$ of the magnetically hard particles and the volume resistivity $R_s$ of the magnetically soft particles is expressed by the formula: $R_s<R_h$.

It is preferred that the magnetically hard particles and the magnetically soft particles used in the present invention be subjected to a pre-treatment to impart a lipophilic property thereto (lipophilic treatment) to form a lipophilic agent coat on at least a part of the surface thereof. The amount of the lipophilic agent coat the surface thereof is usually 0.01 to 5.0% by weight, preferably 0.1 to 5.0% by weight based on the total weight of the particles. In the case of using the magnetically hard and soft particles which are subjected to such a pre-treatment for imparting a lipophilic property thereto, it is preferred to produce the spherical-like composite particles.

As the pre-treatment for imparting a lipophilic property to the magnetically hard particles and the magnetically soft particles, there may be exemplified a method of treating these particles with a coupling agent such as a silane-based coupling agent or a titanate-based coupling agent; a method of dispersing these particles in an aqueous solvent containing a surfactant to absorb the surfactant onto the surfaces of the particles; or the like.

As the silane-based coupling agent, there may be exemplified those having a hydrophobic group, an amino group or an epoxy group. Examples of the silane-based coupling agents having a hydrophobic group may include vinyl trichlorosilane, vinyl triethoxysilane, vinyl tris-(β-methoxy) silane, or the like.

Examples of the silane-based coupling agents having an amino group may include γ-aminopropyl triethoxysilane, N-β-(aminoethyl)-γ-aminopropyl trimethoxysilane, N-β-(aminoethyl)-γ-aminopropylmethyl dimethoxysilane, N-phenyl-γ-aminopropyl trimethoxysilane, or the like.

Examples of the silane-based coupling agents having an epoxy group may include γ-glycidoxy propylmethyl diethoxysilane, γ-glycidoxy propyl trimethoxysilane, β-(3, 4-epoxycyclohexyl)trimethoxysilane, or the like.

Examples of the titanate-based coupling agents may include isopropyl tri-isostearoyl titanate, isopropyl tridodecylbenzene sulfonyl titanate, isopropyl tris (dioctylpyrophosphate)titanate, or the like.

As the surfactant, there can be used commercially available surfactants. The suitable surfactants are those having a functional group capable of directly bonding to the surfaces of the magnetically hard particles or the magnetically soft particles, or of bonding to a hydroxyl group existing on the surfaces of these particles, i.e., cationic surfactants or anionic surfactants are preferred.

By using any of the above-mentioned methods, the aimed composite particles according to the present invention can be obtained. In view of an adhesion property to phenol resin, it is preferred that the magnetically hard and soft particles be treated with the silane-based coupling agent having an amino group or an epoxy group.

The magnetically hard particles and the magnetically soft particles may be subjected to the pre-treatment for imparting a lipophilic property thereto, after both kinds of particles are mixed together. Alternatively, the magnetically hard particles and the magnetically soft particles may be separately subjected to the pre-treatment for imparting a lipophilic property thereto, and then mixed together upon the reaction of the phenols and aldehydes.

The total amount of the magnetically hard particles and the magnetically soft particles when the phenols and the aldehydes are reacted with each other in the presence of the basic catalyst, is 75 to 99% by weight, preferably 78 to 99% by weight based on the total weight of the phenols and the aldehydes. In view of mechanical strength of the composite particles produced, the total amount of the magnetically hard and soft particles in the reaction, is more preferably 80 to 99% by weight based on the total weight of the phenols and the aldehydes.

In accordance with the present invention, the reaction between the phenols and the aldehydes is conducted in the aqueous solvent. In this case, the solid concentration in the aqueous solvent is preferably 30 to 95% by weight, more preferably 60 to 90% by weight.

The reaction between the phenols and the aldehydes may be conducted by gradually heating a mixture of these raw materials up to a reaction temperature of 70 to 90° C., preferably 83 to 87° C. at a temperature rise rate of 0.5 to 1.5° C./minute, preferably 0.8 to 1.2° C./minute while stirring and then reacting the resultant mixture at that temperature for 60 to 150 minutes to cure the phenol resin.

After the curing of the phenol resin, the reaction mixture is cooled to not more than 40° C., thereby obtaining a water dispersion containing spherical-like composite particles constituted by homogeneously dispersing the magnetically hard particles and the magnetically soft particles in a matrix of the cured phenol resin.

Next, the obtained water dispersion was subjected to filtering, centrifugal separation and solid-liquid separation according to ordinary methods. The separated solid component is washed with water and then dried to obtain the spherical-like composite particles constituted by dispersing the magnetically hard particles and the magnetically soft particles in the phenol resin matrix.

Incidentally, the coercive force of the spherical-like composite particles may be controlled to an desired value by optionally selecting the weight ratio of the magnetically hard particles to the magnetically soft particles within the range of usually 1:99 to 99:1, preferably 10:90 to 90:10.

Further, on the surface of the spherical-like composite particles may be formed a resin layer in order to improve the durability thereof and control the volume resistivity thereof while keeping the aimed effects of the present invention. The surface resin layer may be made of at least one resin selected from the group consisting of phenol resin, epoxy resin, polyester resin, styrene resin, silicone resin, melamine resin, polyamide resin and fluorine-containing resin. In this case, the surface resin layer may be formed by any known methods.

The important aspect of the present invention is to provide spherical-like composite particles having a freely controllable coercive force and a high volume resistivity.

The control of the coercive force of the spherical-like composite particles can be achieved by optionally changing the weight ratio of the magnetically hard particles having a coercive force of not less than 500 Oe to the magnetically soft particles having a coercive force of less than 500 Oe.

However, in the conventional composite particles containing both high-coercive force magnetic particles and low-coercive force magnetic particles, attention have been paid only to control of the coercive force thereof. As a result, the conventional composite particles cannot exhibit a sufficiently high volume resistivity. That is, the volume resistivity of composite particles is considerably influenced by the amount of magnetic particles exposed to the surfaces thereof. For example, in Examples of Japanese Patent Applications Laid-open Nos. 6-11906(1994) and 6-35231(1994), the average particle size of magnetic particles having a low volume resistivity is identical to or larger than that of magnetic particles having a high volume resistivity. Therefore, such magnetic particles having a low volume resistivity tend to be exposed to the surfaces of the composite particles, and as a result, the volume resistivity of the composite particles is low.

Further, the reason why the spherical-like composite particles according to the present invention can have a high volume resistivity, is considered as follows. That is, by adjusting the ratio ($\phi_a/\phi_b$) of the average particle size ($\phi_a$) of the magnetically hard particles having a high volume resistivity to the average particle size ($\phi_b$) of the magnetically soft particles having a low volume resistivity to more than 1, the magnetically hard particles having a larger average particle size tend to be more readily exposed to the surfaces of the composite particles as compared to the magnetically soft particles having a smaller average particle size, when formed into the composite particles using a phenol resin as a binder. Accordingly, a larger amount of the magnetically hard particles having a high volume resistivity are present on the surfaces of the composite particles, so that the composite particles can exhibit a high volume resistivity.

Meanwhile, in the case where magnetoplumbite-type magnetic particles are used as the magnetically hard particles and spinel-type magnetic particles are used as the magnetically soft particles, it becomes possible to freely control a coercive force of the obtained composite particles within such a range that the total content of both kinds of magnetic particles is 80 to 99% by weight, while maintaining an appropriate specific gravity of the composite particles because both kinds of magnetic particles have almost the same specific gravity.

An electrophotographic magnetic carrier according to the present invention comprises the spherical-like composite particles comprising magnetically hard particles having a coercive force of not less than 500 Oe, magnetically soft particles having a coercive force of less than 500 Oe and a phenol resin as a binder.

Further, by magnetizing the obtained spherical-like composite particles so as to attain aimed magnetic properties, it becomes possible to control the coercive force of the composite particles as required.

Thus, when the spherical-like composite particles according to the present invention are used as a magnetic carrier, the magnetic properties thereof can be controlled in conformity to a developing system used. In addition, since the composite particles have such a specific gravity as not to cause any damage to toner, the developer can be prevented from being excessively spent. Accordingly, the spherical-like composite particles according to the present invention is suitably used as an electrophotographic magnetic carrier.

As described above, since the coercive force of the spherical-like composite particles according to the present invention is freely controlled by varying the weight ratio of the magnetically hard particles to the magnetically soft particles, and since the content of the magnetically hard and soft particles in the composite particles is kept large, the spherical-like composite particles can be suitably applied to a developer material for developing an electrostatic latent image, such as an electrophotographic magnetic carrier or an electrophotographic magnetic toner, a wave absorbing material, an electromagnetic shielding material, an ion exchange resin material, a display material, a damping material or the like. Especially, the spherical-like composite particles according to the present invention is suitable as an electrophotographic magnetic carrier.

EXAMPLES

The present invention will now be described in more detail with reference to the following examples, but the present invention is not restricted to those examples and various modifications are possible within the scope of the invention.

(1) In the following Examples and Comparative Examples, the average particle size of particles were measured by a laser diffraction-type granulometer (manufactured by HORIBA SEISAKUSHO CO., LTD.). In addition, the shape of particles were observed by a scanning electron microscope S-800 (manufactured by HITACHI LIMITED).

(2) The sphericity of particles was expressed by the ratio (l/w) obtained by measuring an average major axial diameter (l) and an average minor axial diameter (m) of 300 particles selected from not less than 300 composite particles on the scanning electron microscope (SEM) photograph.

(3) The true specific gravity was measured by a multi-volume densitometer (manufactured by MICROMELITIX CO., LTD.).

(4) The bulk density was measured according to a method prescribed in JIS K5101.

(5) The coercive force and the saturation magnetization were measured at an external magnetic field of 10 kOe by a sample vibration-type magnetometer VSM-3S-15 (manufactured by TOEI KOGYO CO., LTD.).

(6) The volume resistivity was measured by a high resistance meter 4329A (manufactured by YOKOGAWA HEWLETT PACKARD CO., LTD.).

(7) The fluidity was expressed by a flow rate calculated by dividing the weight (50 g) of composite particles by a drop time (second) thereof, which drop time was measured by dropping the composite particles filled in a glass funnel (opening: 75ϕ; height: 75 mm; inner diameter of conical section: 6ϕ; length of straight pipe section: 30 mm) by applying a predetermined amount of vibration to the funnel.

Example 1

200 g of barium ferrite particles having a coercive force of 2,780 Oe were charged into a Henschel mixer and mixed intimately. Thereafter, 2.0 g of a silane-based coupling agent (Tradename: KBM-403, produced by SHIN-ETSU KAGAKU CO., LTD.) was added to the barium ferrite particles, and the mixture was heated to about 100° C. and intimately stirred at that temperature for 30 minutes, thereby obtaining barium ferrite particles coated with the silane-based coupling agent (magnetically hard particles).

Separately, 200 g of magnetite particles having a coercive force of 59 Oe were charged into a Henschel mixer and mixed intimately. Thereafter, 2.0 g of a silane-based coupling agent (Tradename: KBM-602, produced by SHIN-ETSU KAGAKU CO., LTD.) was added to the magnetite particles, thereby obtaining magnetite particles coated with the silane-based coupling agent (magnetically soft particles).

45 g of phenol, 55 g of 37% formalin, 400 g (in total) of the magnetically hard and soft particles subjected to the above pre-treatment for imparting a lipophilic property thereto, 15 g of 28% ammonia water and 45 g of water were filled in an one-liter four-neck flask and mixed together. The resultant mixture was heated to 85° C. for 40 minutes while stirring and reacted at that temperature for 180 minutes to cure a resin component therein, thereby producing composite particles comprising the magnetically hard particles, the magnetically soft particles and the cured phenol resin.

Next, after the content of the flask was cooled to 30° C., 0.5 liter of water was added thereto to separate the content into a supernatant as an upper layer and a precipitate as a lower layer. The supernatant was removed and the precipitate containing the composite particles were washed with water and then dried by blowing air.

The obtained dry particles were further dried under reduced pressure of not more than 5 mmHg at a temperature of 150 to 180° C. to obtain dry composite particles.

The average particle size of the thus obtained composite particles was 55 μm. As a result of the measurement by a scanning electron microscope (×1,000), it was determined that the obtained composite particles had a sphericity of 1.1 and was of a near-spherical shape, as shown in FIG. 1.

Also, it was confirmed that the obtained spherical-like composite particles exhibited excellent properties required for a magnetic carrier of an electrophotographic developer.

Specifically, the obtained spherical-like composite particles had a bulk density of 1.86, a specific gravity of 3.65, a fluidity of 31 seconds and a volume resistivity of $2.0\times10^{11}$ Ωcm. The total content of the magnetically hard particles and the magnetically soft particles in the composite particles was 88.5% by weight. With respect to magnetic properties of the obtained spherical-like composite particles, the coercive force thereof was 460 Oe and the saturation magnetization thereof was 65.6 emu/g.

Examples 2 to 5 and Comparative Examples 1 to 2

The same procedure as defined in Example 1 was conducted except that kind and amount of the magnetically hard particles, kind and amount of the magnetically soft particles, kind and amount of the treating agent used in the pre-treatment for imparting a lipophilic property to the magnetically hard and soft particles, amount of phenol, amount of 37% formalin, amount of ammonia water as a basic catalyst and amount water added, were varied. The production conditions are shown in Table 1 and properties of the obtained composite particles are shown in Table 2.

TABLE 1

| Examples and Comparative Examples | Production conditions of spherical-like composite particles | | | |
|---|---|---|---|---|
| | Magnetically hard particles | | | |
| | Kind | Average particle size ($\phi_a$) (μm) | Coercive force (Oe) | Volume resistivity (Ωcm) |
| Example 1 | Strontium ferrite (granular) | 0.61 | 4015 | $5\times10^{12}$ |
| Example 2 | Barium ferrite (granular) | 0.63 | 3100 | $6\times10^{12}$ |
| Example 3 | Barium ferrite (plate-like) | 0.73 | 2780 | $6\times10^{12}$ |
| Example 4 | Barium ferrite (plate-like) | 0.63 | 3100 | $6\times10^{12}$ |
| Comparative Example 1 | Barium ferrite (plate-like) | 0.28 | 2900 | $2\times10^{10}$ |
| Comparative Example 2 | Cobalt-coated maghemite (acicular) | 0.50 | 615 | $7\times10^{9}$ |
| Comparative Example 3 | Barium ferrite (plate-like) | 0.73 | 2780 | $6\times10^{12}$ |

| | Magnetically hard particles | | |
|---|---|---|---|
| | | Treating agent used in pre-treatment for imparting lipophilic property | |
| | Amount (g) | Kind | Amount (g) |
| Example 1 | 150 | Silane-based coupling agent (KBM-403 produced by SHIN-ETSU KAGAKU CO., LTD.) | 1.8 |
| Example 2 | 380 | Silane-based coupling agent (KBM-403 produced by SHIN-ETSU KAGAKU CO., LTD.) | 7.0 |
| Example 3 | 50 | Silane-based coupling agent (KBM-403 produced by SHIN-ETSU KAGAKU CO., LTD.) | 1.0 |
| Example 4 | 250 | Silane-based coupling agent (KBM-602 produced by SHIN-ETSU KAGAKU CO., LTD.) | 3.8 |
| Comparative Example 1 | 380 | Silane-based coupling agent (KBM-403 produced by SHIN-ETSU KAGAKU CO., LTD.) | 1.8 |
| Comparative Example 2 | 200 | Silane-based coupling agent (KBM-403 produced by SHIN-ETSU KAGAKU CO., LTD.) | 4.0 |
| Comparative Example 3 | 200 | — | — |

| | Magnetically soft particles | | | |
|---|---|---|---|---|
| | Kind | Average particle size ($\phi_a$) (μm) | Coercive force (Oe) | Volume resistivity (Ωcm) |
| Example 1 | Spherical magnetite | 0.40 | 59 | $2\times10^{7}$ |
| Example 2 | Granular nickel-zinc ferrite | 0.40 | 1 | $5\times10^{8}$ |
| Example 3 | Spherical magnetite | 0.13 | 81 | $4\times10^{7}$ |

TABLE 1-continued

| Examples and Comparative Examples | Production conditions of spherical-like composite particles | | | |
|---|---|---|---|---|
| Example 4 | Octahedral magnetite | 0.33 | 107 | $2 \times 10^7$ |
| Comparative Example 1 | Octahedral magnetite | 0.32 | 122 | $2 \times 10^7$ |
| Comparative Example 2 | Spherical magnetite | 0.23 | 59 | $3 \times 10^7$ |
| Comparative Example 3 | Spherical magnetite | 0.23 | 59 | $3 \times 10^7$ |

| | Magnetically soft particles | | |
|---|---|---|---|
| | | Treating agent used in pre-treatment for imparting lipophilic property | |
| | Amount (g) | Kind | Amount (g) |
| Example 1 | 250 | titanium-based coupling agent (KR-TTS produced by AJINOMOTO CO., LTD.) | 3.75 |
| Example 2 | 20 | Silane-based coupling agent (KBM-403 produced by SHIN-ETSU KAGAKU CO., LTD.) | 0.20 |
| Example 3 | 350 | Silane-based coupling agent (KBM-403 produced by SHIN-ETSU KAGAKU CO., LTD.) | 7.0 |
| Example 4 | 150 | Silane-based coupling agent (KBM-602 produced by SHIN-ETSU KAGAKU CO., LTD.) | 1.8 |
| Comparative Example 1 | 20 | Silane-based coupling agent (KBM-403 produced by 5HIN-ETSU KAGAKU CO., LTD.) | 1.8 |
| Comparative Example 2 | 200 | Silane-based coupling agent (KBM-403 produced by SHIN-ETSU KAGAKU CO., LTD.) | 2.0 |
| Comparative Example 3 | 200 | — | — |

| | | Amount of | Amount of 37% | Basic catalyst | | Amount of |
|---|---|---|---|---|---|---|
| | $\phi_a/\phi_b$ | phenol (g) | for-malin | Kind | Amount (g) | water (g) |
| Example 1 | 1.53 | 47 | 57 | Ammonia water | 16 | 60 |
| Example 2 | 1.58 | 42 | 50 | Ammonia water | 13 | 40 |
| Example 3 | 5.60 | 45 | 55 | Ammonia water | 15 | 50 |
| Example 4 | 1.91 | 42 | 52 | Ammonia water | 13 | 35 |
| Comparative Example 1 | 0.88 | 40 | 50 | Ammonia water | 12 | 40 |
| Comparative Example 2 | 2.17 | 50 | 65 | Ammonia water | 18 | 60 |
| Comparative Example 3 | 3.17 | Mixed with polyethylene resin (ADOMAR NS101), kneaded and pulverized | | | | |

TABLE 2

| Examples and Comparative Examples | Properties of spherical-like composite particles | | | |
|---|---|---|---|---|
| | Shape | Average particle size ($\mu$m) | Sphericity | Bulk density (g/ml) |
| Example 1 | Spherical | 37 | 1.1 | 1.75 |
| Example 2 | Spherical | 25 | 1.1 | 1.62 |
| Example 3 | Spherical | 46 | 1.1 | 1.78 |
| Example 4 | Spherical | 85 | 1.1 | 1.97 |
| Comparative Example 1 | Spherical | 78 | 1.1 | 1.95 |
| Comparative Example 2 | Spherical | 32 | 1.1 | 1.82 |
| Comparative Example 3 | Amorphous | 33 | — | 1.32 |

| | Specific gravity | Fluidity (sec) | Volume resistivity (Ωcm) |
|---|---|---|---|
| Example 1 | 3.53 | 40 | $3 \times 10^{10}$ |
| Example 2 | 3.65 | 45 | $7 \times 10^{12}$ |
| Example 3 | 3.62 | 28 | $2 \times 10^{10}$ |
| Example 4 | 3.67 | 23 | $3 \times 10^{11}$ |
| Comparative Example 1 | 3.67 | 25 | $7 \times 10^{8}$ |
| Comparative Example 2 | 3.51 | 34 | $5 \times 10^{8}$ |
| Comparative Example 3 | 3.15 | unmeasurable | $3 \times 10^{11}$ |

| | Content of magnetic particles (wt. %) | Coercive force (Oe) | Saturation magnetization (emu/g) |
|---|---|---|---|
| Example 1 | 88.3 | 320 | 61.0 |
| Example 2 | 88.1 | 2500 | 62.5 |
| Example 3 | 88.4 | 170 | 78.2 |
| Example 4 | 89.3 | 2200 | 55.5 |
| Comparative Example 1 | 89.2 | 1480 | 53.2 |
| Comparative Example 2 | 88.0 | 180 | 74.3 |
| Comparative Example 3 | 80.0 | 400 | 59.0 |

Comparative Example 3

The same magnetically hard particles and the same magnetically soft particles as used in Example 1 which were, however, subjected to no pre-treatment for imparting a lipophilic property thereto, were mixed with a commercially available polyethylene resin (Tradename: ADOMAR NS101, produced by MITSUI PETROCHEMICAL CO., LTD.) at the same weight ratio as in Example 1 in a Henschel mixer and sufficiently pre-dried therein. Thereafter, the resultant mixture was kneaded by an extruder, and subjected to pulverization and classification to obtain composite particles.

The obtained composite particles were of an irregular shape, and had an average particle size of 33 $\mu$m. In addition, the total content of the magnetic particles in the obtained composite particles was 80% by weight.

The obtained composite particles exhibited extremely deteriorated fluidity, so that it was impossible to measure the fluidity. Other properties of the composite particles are shown in Table 2.

What is claimed is:

1. Spherical composite particles having an average particle size of 1 to 1,000 $\mu$m, a volume resistivity of $10^{10}$ to $10^{13}$ Ωcm and a coercive force of 100 to 4,000 Oe, comprising:

magnetically hard particles, magnetically soft particles and a phenol resin as a binder, the total amount of said magnetically hard particles and said magnetically soft particles being 80 to 99% by weight based on the total weight of said spherical composite particles, and the ratio (ϕa/ϕb) of an average particle size (ϕa) of said magnetically hard particles to an average particle size (ϕb) of said magnetically soft particles being more than 1.2.

2. Spherical composite particles according to claim 1, wherein said magnetically hard particles have a coercive force of not less than 500 Oe and said magnetically soft particles have a coercive force of less than 500 Oe.

3. Spherical composite particles according to claim 2, wherein said magnetically hard particles have a coercive force of 700 to 5,000 Oe.

4. Spherical composite particles according to claim 2, wherein said magnetically soft particles have a coercive force of 1 to 400 Oe.

5. Spherical composite particles according to claim 1, wherein said magnetically hard particles are magnetoplumbite magnetic particles, magnetic iron particles having an oxide layer on the surface thereof or magnetic iron-based alloy particles having an oxide layer on the surface thereof.

6. Spherical composite particles according to claim 1, wherein said magnetically hard particles have an average particle size of 0.05 to 10 μm.

7. Spherical composite particles according to claim 1, wherein said magnetically hard particles have a volume resistivity of $10^9$ to $10^{13}$ Ωcm.

8. Spherical composite particles according to claim 1, wherein said magnetically soft particles are magnetite particles, maghemite particles or spinel ferrite particles containing at least one other metal than iron.

9. Spherical composite particles according to claim 1, wherein said magnetically soft particles have an average particle size of 0.02 to 5 μm.

10. Spherical composite particles according to claim 1, wherein said magnetically soft particles have a volume resistivity of $10^5$ to $10^{11}$ Ωcm.

11. Spherical composite particles according to claim 1, wherein the volume resistivity of said magnetically hard particles is more than that of said magnetically soft particles.

12. Spherical composite particles according to claim 1, wherein said magnetically hard particles and said magnetically soft particles are mixed together at a weight ratio of 1:99 to 99:1.

13. Spherical composite particles according to claim 1, which further have a bulk density of not more than 2.5 g/cm$^3$ and a specific gravity of 2.5 to 5.2.

14. Spherical composite particles according to claim 1, wherein said volume resistivity is $10^{11}$ to $10^{13}$ Ωcm.

15. Spherical composite particles according to claim 1, wherein said magnetically hard particles and said magnetically soft particles have a lipophilic agent coat on at least a part of the surface of the particles.

16. Spherical composite particles according to claim 15, wherein said lipophilic agent coat comprises a silane-based coupling agent, a titanate-based coupling agent, or a surfactant.

17. Spherical composite electrophotographic magnetic carrier particles having an average particle size of 1 to 1,000 μm, a volume resistivity of $10^{10}$ to $10^{13}$ Ωcm and a coercive force of 100 to 4,000 Oe, comprising:

magnetically hard particles, magnetically soft particles and a phenol resin as a binder, the total amount of said magnetically hard particles and said magnetically soft particles being 80 to 99% by weight based on the total weight of said spherical composite particles, and the ratio (ϕa/ϕb) of an average particle size (ϕa) of said magnetically hard particles to an average particle size (ϕb) of said magnetically soft particles being more than 1.2.

18. Spherical composite particles according to claim 1, which further have a sphericity of 1.0 to 1.4.

19. Electrophotographic magnetic carrier particles having an average particle size of 1 to 1,000 μm, a volume resistivity of $10^{10}$ to $10^{13}$ Ωcm and a coercive force of 100 to 4,000 Oe, comprising:

magnetically hard particles, magnetically soft particles and a phenol resin as a binder, the total amount of said magnetically hard particles and said magnetically soft particles being 80 to 99% by weight based on the total weight of said particles, and the ratio (ϕa/ϕb) of an average particle size (ϕa) of said magnetically hard particles to an average particle size (ϕb) of said magnetically soft particles being more than 1.2.

20. Spherical composite electrophotographic magnetic carrier particles according to claim 19, wherein said magnetically hard particles and said magnetically soft particles have a lipophilic agent coat on at least a part of the surface of the particles.

21. A developer for electrophotography, comprising spherical composite electrophotographic magnetic carrier particles having an average particle size of 1 to 1,000 μm, a volume resistivity of $10^{10}$ to $10^{13}$ Ωcm and a coercive force of 100 to 4,000 Oe, comprising:

magnetically hard particles, magnetically soft particles and a phenol resin as a binder, the total amount of said magnetically hard particles and said magnetically soft particles being 80 to 99% by weight based on the total weight of said spherical composite particles, and the ratio (ϕa/ϕb) of an average particle size (ϕa) of said magnetically hard particles to an average particle size (ϕb) of said magnetically soft particles being more than 1.2, and toner particles.

* * * * *